United States Patent [19]

Troutner et al.

[11] 3,963,552

[45] June 15, 1976

[54] METHOD OF FEEDING SHEETS TO A CONTINUOUS LAMINATING PRESS

[75] Inventors: Arthur L. Troutner; John R. Russell; Alan W. Johnson; Clifford R. Johnson, all of Boise, Idaho

[73] Assignee: Trus Joist Corporation, Boise, Idaho

[22] Filed: May 8, 1974

[21] Appl. No.: 467,944

Related U.S. Application Data

[62] Division of Ser. No. 258,898, June 1, 1972, Pat. No. 3,841,145.

[52] U.S. Cl. ..... 156/299; 156/304; 271/216

[51] Int. Cl.[2] ..... B65H 29/66

[58] Field of Search ..... 156/157, 159, 304, 299, 156/300, 538, 559, 566, 580; 198/234; 271/216

[56] References Cited

UNITED STATES PATENTS

| | | | |
|---|---|---|---|
| 3,463,295 | 8/1969 | Shelton | 271/216 |
| 3,686,061 | 8/1972 | Brown et al. | 156/157 |
| 3,790,428 | 2/1974 | Linel | 156/299 |

*Primary Examiner*—William A. Powell
*Assistant Examiner*—Jerome W. Massie
*Attorney, Agent, or Firm*—Eugene D. Farley

[57] ABSTRACT

Sheets of material, wood veneers in particular, are assembled into a continuous, linear, composite stack by arranging a first stack of sheets above a lineal conveyer with the sheets progressively lapped by predetermined increments in the direction of movement of the conveyer. The bottom-most sheet is deposited on the conveyer. The conveyer is advanced a predetermined linear travel increment while placing the first sheet of a second stack on the introduced with its leading end overlapping the trailing end of the sheet from the first stack already there.

The stepwise advancement of the conveyer is continued while alternately depositing and lapping additional sheets. When the first stack has been completely deposited, the second stack is elevated above the conveyer and a third stack interleaved with the second stack in the same progression. This sequence is continued indefinitely, producing a continuous, linear, composite stack of sheet materials. Where the stack comprises glue-coated sheets of wood veneer, it may be inroduced into a continuous press for the production of a glued, laminar wood product.

3 Claims, 18 Drawing Figures

366
368
370
356
354
362
194
112
34
36
46
14
V
V'

METHOD OF FEEDING SHEETS TO A CONTINUOUS LAMINATING PRESS

This is a division of application Ser. No. 258,898, filed June 1, 1972, now U.S. Pat. No. 3,841.945.

This invention relates to a method of assembling sheets of material, particularly glue-coated wood veneer sheets, into a continuous linearly-extending, composite stack suitable for introduction into a continuous press. It relates further to the composite product which is produced by the method and to an apparatus for use in the execution of the method. The invention is applicable particularly to the assembling of glue-coated wood veneers into a continuous, linearly-extending, composite stack and is described with reference to such application although no limitation thereby is intended.

BACKGROUND OF THE INVENTION

In the co-pending application of Arthur L. Troutner Ser. No. 79,839, filed Oct. 12, 1970 now Pat. No. 3,723,230 for a CONTINUOUS PRESS FOR PRESSING GLUE-COATED CONSOLIDATABLE PRESS CHARGES, there is described a continuous press to which is fed continuously a charge comprising stacked, glue-coated wood laminae or other sheet materials. The press successfully converts this charge into a consolidated, unitary, laminar product such as gluelam beams or timbers. However, it has been found that the character and arrangement of the unconsolidated stack of sheets fed to the press has a material and critical influence on the properties of the consolidated product produced by the press.

Thus, since the continuous charge fed to the press necessarily must consist of a multiplicity of sheets of wood veneer or other material pieced together in one manner or another, it necessarily follows that the final consolidated product discharged from the press will possess a multiplicity of joints occurring at the points of contact of any two adjacent sheets. If the joints are too closely aligned with each other across the thickness of the product, or too close together longitudinally of the product, planes or areas of structural weakness are introduced. Also, any irregularity in the spacing of the joints along the length of the product introduces a corresponding irregularity in the strength qualities of the product. These factors may detract materially from the commercial application of the product.

Where the starting materials comprise wood veneer sheets, a difficulty is presented in that the sheets are fragile and break easily, particularly along the grain and in areas of defective wood. This makes difficult the problem of stacking them into a continuous press charge.

Still further, where the wood veneers are commercial veneers produced by usual manufacturing processes, they almost invariably are of different widths. The width differences are occasioned by numerous factors, including the veneer clipping routine, breakage, and shrinkage occurring in the dryer. Clipping the veneers to uniform width obviously introduces a substantial waste factor. Using veneers of random width, on the other hand, tends to produce a press charge of non-uniform thickness along its longitudinal margins. This in turn makes necessary trimming the consolidated press product to remove the defective margins, with attendant loss of material.

Another problem in the composition of a continuous press charge resides in the fact that the sheet employed as raw materials, and in particular plywood veneers, are wavy and nonplanar to a pronounced degree. Consequently unless appropriately restrained, they will not lie flat as they are stacked upon one another. The necessary effect of this property of the veneers is the composition of a stack which is unduly thick and irregular and from which the veneers tend to become dislodged as they are moved from place to place, thereby interfering with the operation of the conveyers, clogging press openings, and producing a substandard product.

Further apparent is the difficulty inherent in stacking a multiplicity of wood veneers or other sheet materials of wavy configuration, irregular widths, and subject to breakage, on a continuous basis, at a rate sufficient to sustain economical production by a cooperating continuous press.

It accordingly is the general purpose of the present invention to provide a method of assembling sheet of material, particularly wood veneers, into a continuous, linear stack of substantially uniform dimensions and qualities, adaptable for introduction into a continuous press, at a commercially feasible production rate.

It is a further object of the present invention to provide a novel laminar product resulting from the method of the invention, and to provide apparatus for its practice.

BRIEF STATEMENT OF THE INVENTION

In its broad aspect, the present invention comprises a method, apparatus employed in executing the method, and a novel product of the method, for assembling sheets of material, particularly wood veneers, into a linearly-extending composite stack suitable for introduction into a continuous press.

In carrying out the method, a first stack of the sheets is arranged above a linear conveyor with the sheets progressively lapped by predetermined increments in the direction of movement of the conveyor. The lowermost sheet is deposited on the conveyor, the conveyor advanced a predetermined linear travel increment, and the first sheet of a second stack placed on the conveyor with its leading end lapping the trailing end of the sheet from the first stack already deposited thereon.

This sequence is repeated until all of the first stack has been deposited on the conveyor in a vertically offset or staggered manner, and a second stack has been built up with the leading ends of the sheets of the second stack lapping the trailing ends of the sheets of the first stack. At least the trailing portion of the second stack then is lifted and the foregoing sequence repeated to build up a third stack of the same nature, with the leading ends of its component sheets interleaved with and lapping the trailing ends of the components sheets of the second stack. This procedure is repeated indefinitely, producing a continuous, linear, composite stack made up of a plurality of component interleaved and lapping individual stacks.

During the foregoing procedure, the individual sheets are aligned in the stacks and the lapped joints produced between the sheets are staggered and disposed in a uniform arrangement, thereby leading to the production of a laminar product of uniform properties requiring but a minimum of trim.

DESCRIPTION OF A SPECIFIC EMBODIMENT OF THE INVENTION

Figure 1A:
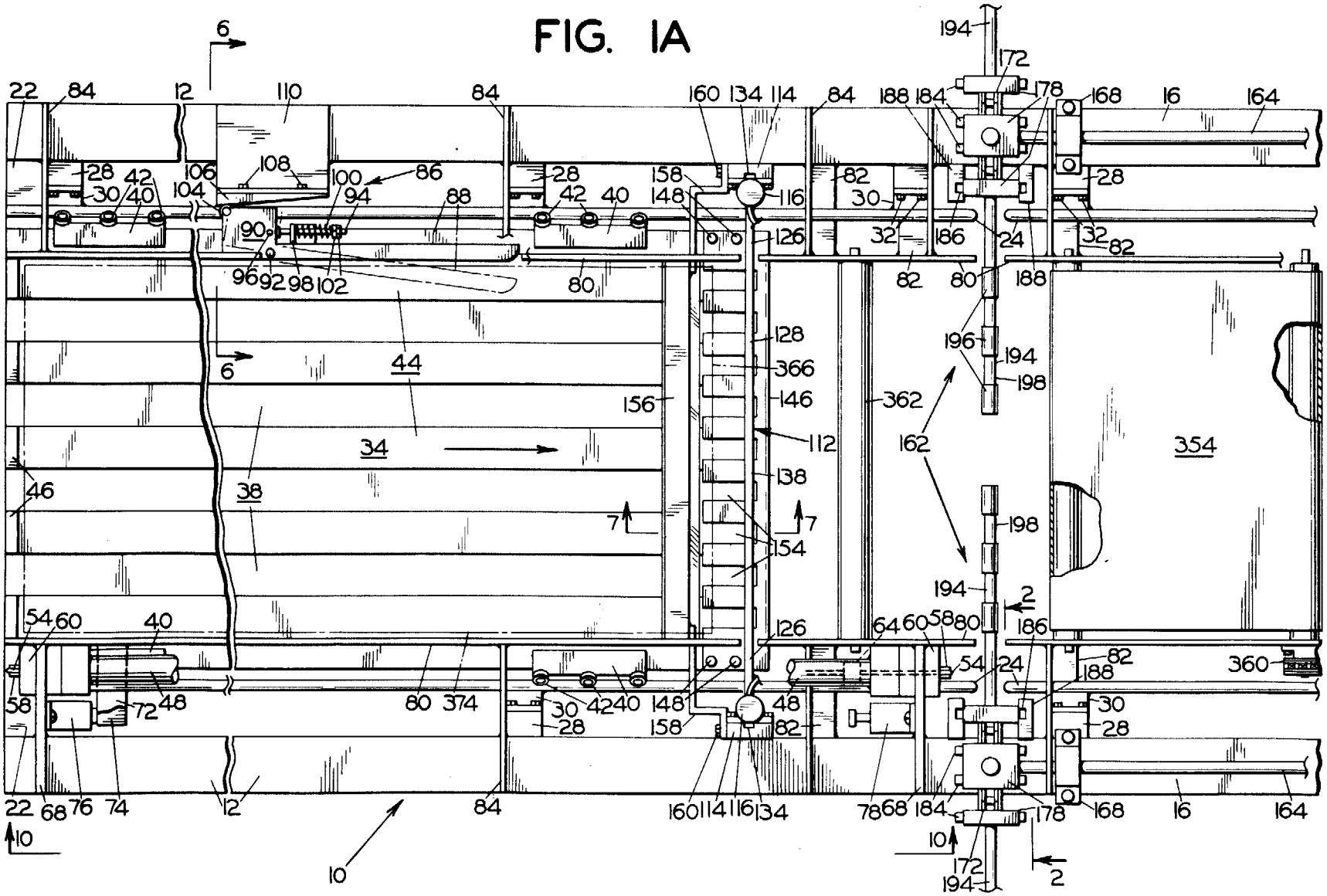
FIGS. 1A and 1B are sequential plan views of the apparatus, with parts broken away for convenience of illustration.

A. The Raw Material.

As has been indicated above, the presently described apparatus may be applied to the arrangement of a variety of sheet materials into a lineal stack. Thus it may be applied to the production of a stack of sheets of mineral materials, wood particle board, wood fiberboard, or various plastics. It is particularly applicable, however, to the assembling of gluecoated wood laminae, specifically plywood veneers, in the production of lumber and heavy timbers.

In one commercial form of the apparatus, it composites a continuous, glued, laminated billet of indefinite length, having a width of three or four feet, and a thickness of from 2 to 4 inches. Such a billet may be sawed longitudinally in the production of beams, timbers, joist chords, or other structural members of great and uniform strength.

The plywood veneers which comprise the preferred raw material for the present purposes consist of the commercially produced veneers normally used in the production of plywood. Such veneers have a uniform length of slightly more than eight feet, non-uniform widths, and a substantially uniform thickness of about ⅛ inch. However, various veneer thicknesses may be employed with suitable modification of the layup pattern.

In the preparation of the veneers, they are sorted or cut to a width corresponding approximately to the width of the layup apparatus and downstream press. They then are glue-coated by any of the conventional techniques, i.e. by spraying, curtain coating, brushing, or roll coating. Sufficient glue is employed to fill any voids and coat the surfaces. Thermosetting or cold setting glues may be employed.

The glue-coated veneers then are charged to the hereindescribed apparatus, which basically consists of six sub-assemblies: A reciprocating shuttle conveyor which feeds the veneers, a veneer aligning assembly which aligns the veneers on the shuttle conveyor, a horizontally indexing gate assembly which aligns the sheets on the shuttle conveyor and assists in their discharge therefrom; a vertically indexing support arm assembly which supports the sheets in staggered, stacked arrangement preliminary to assembling them; a hold-down assembly which holds down and restrains the assembled continuous stack of sheets; and a lineal conveyor assembly which offbears the continuous stack to farther processing, for example to a continuous press.

Considered in detail, with particular reference to the drawings, the construction and mode of operation of these subassemblies, separately and in cooperation with the companion sub-assemblies, is as follows:

B. The Shuttle Conveyor.

To increase the production rate, and also to produce a desirably spaced joint pattern in the final assembly, two or more shuttle conveyors preferably are employed in the present apparatus. They serve the functions of aligning the sheets and feeding them one at a time to build up the lapped, continuous, composite stack which is the product of the apparatus. In the presently illustrated form of the invention, there are two such shuttle conveyors.

The shuttle conveyor, indicated generally at 10, together with the other sub-assemblies of the apparatus of our invention, is mounted on a frame 12 which in turn is supported on legs 14. The frame consists of upper and lower longitudinal structural members 16 and 18, supported by uprights 20 and braced by cross members 22.

To support the two shuttle conveyors employed in the presently illustrated embodiment, there are upper and lower segmented rails 24, 26. These are mounted detachably on horizontal frame members 16, 18, respectively, by means of mounting blocks 28. Preshaped brackets 30, integral with rails 24 and 26, are secured to blocks 28 by means of bolts 32.

The upper and lower shuttle conveyors are indicated generally at 34 and 36, respectively. Each consists of a bed plate 38 carrying at spaced intervals along its longitudinal side margins a plurality of mounting blocks 40. Angled wheels 42 are rotatably mounted on the blocks.

The wheels track on upper and lower rails 24, 26. Where the shuttle conveyor is to be applied to the conveyance of commercial plywood veneers, there may be six mounting blocks 40, each rotatably mounting six wheels 42.

The bed plate 38 of each shuttle conveyer has spaced shallow ribs 44 extending its full length, FIG. 1A. The ribs are separated by grooves which are of functional importance in discharging the sheet from the conveyer, as shall appear hereinafter. A vertically extending guide 45, which also serves as a stop, extends upwardly along the longitudinal side edge of the bed plate. Pushing projections 46 extend upwardly from the rear upper surfaces of ribs 44. These engage the trailing end of each sheet and assist in its propulsion.

Figure 2:
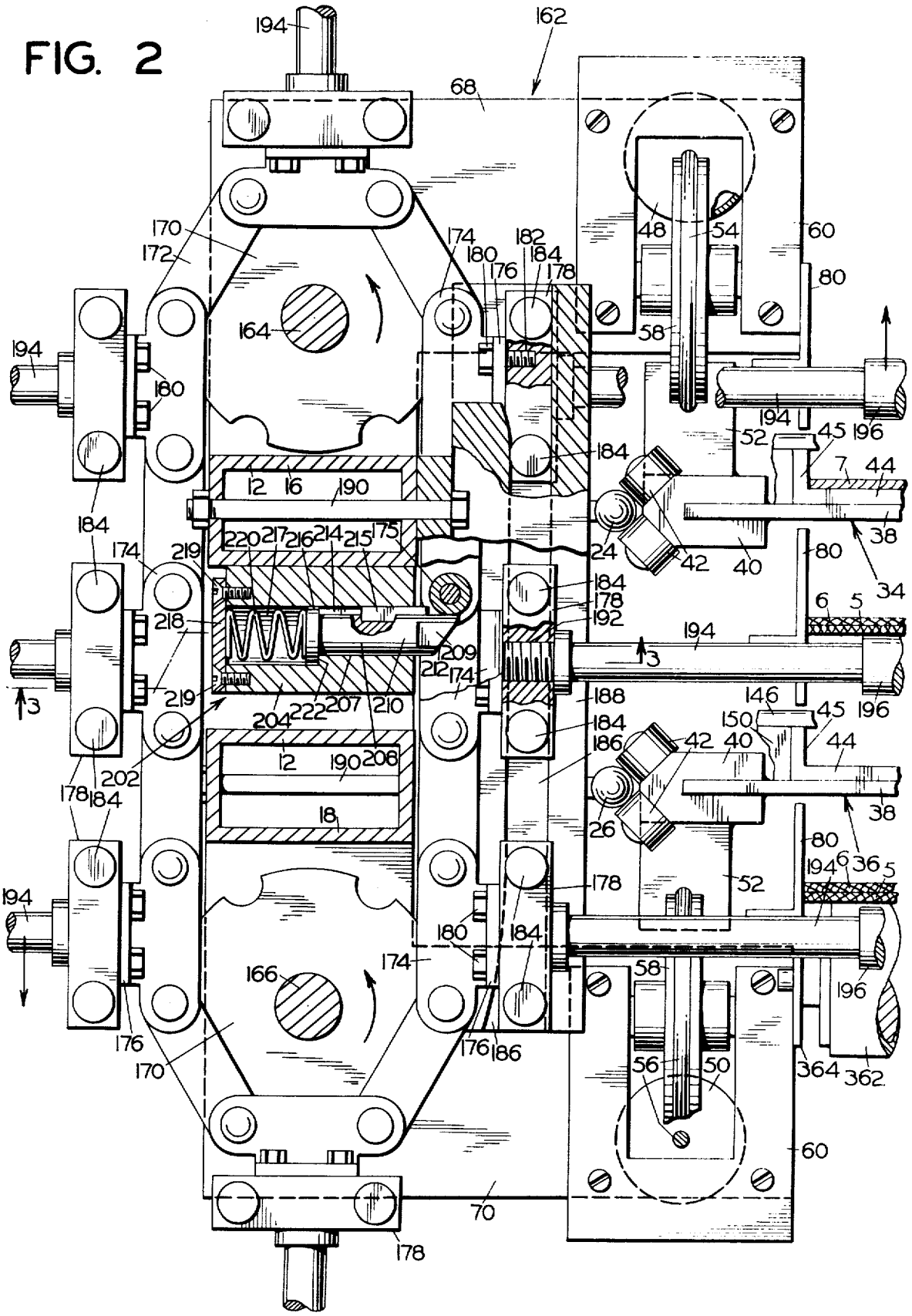
FIG. 2 is a transverse section taken along line 2—2 of FIG. 1A illustrating vertically indexing sheet support arms employed in the hereindescribed apparatus.
Figures 6, 9, 10:
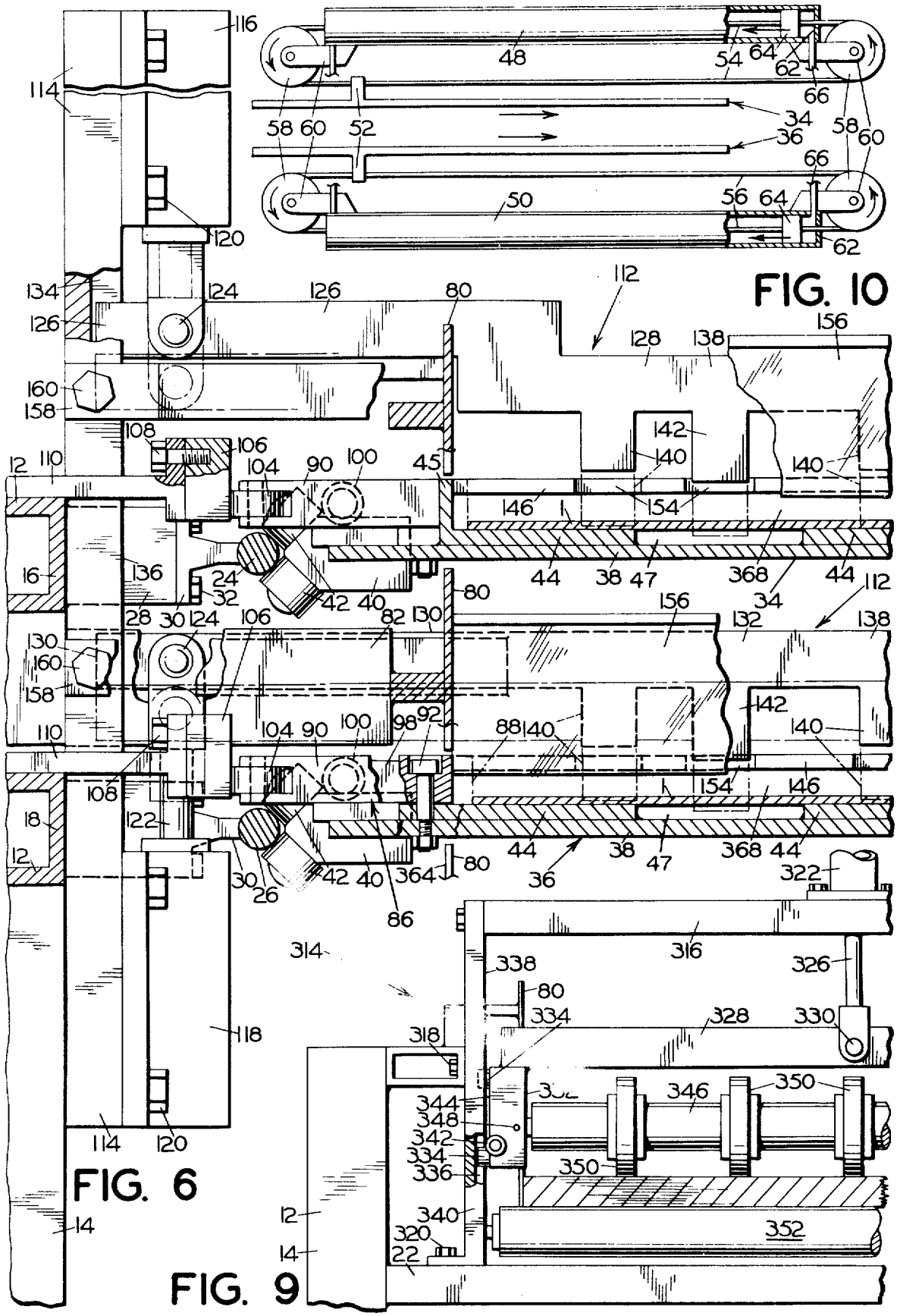
FIG. 6 is a fragmentary, transverse section taken along line 6—6 of FIG. 1A, illustrating aligning means for aligning a sheet being processed by the apparatus.
FIG. 9 is a fragmentary, transverse section taken along line 9—9 of FIG. 1B and illustrating hold-down roller means for the stack.
FIG. 10 is a diagrammatic side elevation, as viewed from lines 10—10 of FIG. 1A, illustrating the drive for a reciprocating or shuttle conveyor employed in the hereindescribed apparatus.

Suitable means are provided for driving each shuttle conveyer 34 and 36 in reciprocating lineal motion. In the illustrated form of the invention, the drive comprises fluid operated cylinders, specifically air cylinders 48 and 50 wih associated cable connections (FIGS. 1A, 2 and 10.).

Each conveyer 34, 36 has an integral mounting post 52 to which one of cables 54, 56 is anchored. The cables are trained around pulleys 58 which are rotatably mounted on brackets 60 secured to cylinders 48, 50. From pulleys 58, each cable passes through a sealing wall 62 with which the associated cylinder is provided, and dead ends at the cylinder piston 64.

Cylinders 48, 50 are supplied with compressed air through conduits 66. Shock absorbing means is associated with each cylinder to absorb the shock necessarily created by the repeated change of direction of the shuttle conveyer. To this end cylinders 48 and 50 are fixed to plates 68, 70 respectively. The latter in turn are supported on horizontal frame members 16, 18.

Bumper arms 72, 74 extend outwardly from the right rear corners of conveyers 34, 36. At the limit of their travel, arms 72, 74 contact shock absorbing units 76, 78 mounted on plates 68.

Means are provided for aligning the sheets and maintaining their alignment as they progress through the apparatus. For this purpose there are provided segmented, spaced, parallel guide fences 80 supported by posts 82 and brackets 84 along the length of the apparatus, FIGS. 1, 2 and 6.

Also, each shuttle conveyor has associated with it horizontal sheet aligning means indicated generally at 86, FIGS. 1A and 6.

Each of the horizontal aligning sub-assemblies comprises a lever arm 88 having a rectangular base 90. The latter is pivotally mounted by shoulder bolt 92 threaded into bed plate 38. The pivotally mounted lever arm is spring pressed in the direction of advancement against a sheet carried by the shuttle conveyer by means of a threaded stud 94. The latter is pivotally mounted by means of pivot pin 96 to the rectangular lever arm base 90. It passes through a plate 98 which is integral with bed plate 38 and mounts a tension spring 100.

Tension spring 100 bears against plate 98 at one end and tension-adjusting lock nuts 102 at the other end. A roller 104 is journaled to the rear outer corner of rectangular base 90. In the retracted position of the carriage, the roller bears against a cam ramp 106. The latter is bolted to brackets 110 on horizontal frame members 16, 18.

In the advancing position of the shuttle conveyer, lever 88 is urged forwardly by spring 100 into engagement with the side edge of a sheet carried by the conveyor. This movement of the lever is permitted by a break in fence 80.

In its forward position, lever 88 bears against the side edge of a sheet carried by the shuttle conveyer, urging it against the opposite side wall of the carriage, thereby aligning it. During the retracting movement of the conveyer, roller 104 on lever base 90 engages cam ramp 106 moving the lever arm to its retracted position and enabling loading a new sheet on the shuttle conveyor.

C. The Indexing Gate Assembly

Figures 3, 5, 7, 8:
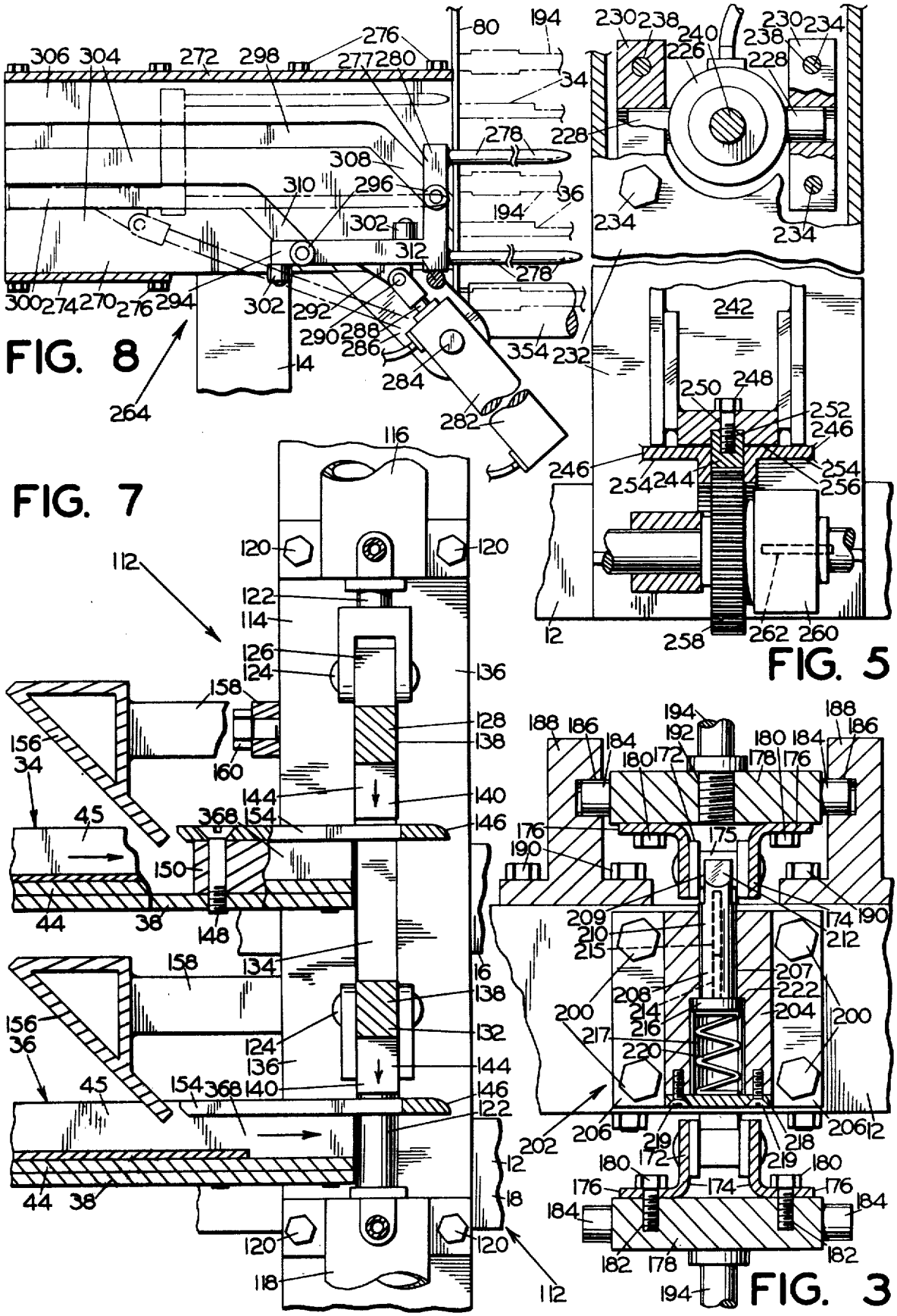
FIG. 3 is a fragmentary, longitudinal section taken along line 3—3 of FIG. 2, illustrating a ratchet control for the support arms.
FIG. 5 is a fragmentary, horizontal section taken on line 5—5 of FIG. 4.
FIG. 7 is a fragmentary, longitudinal section taken along line 7—7 of FIG. 1A illustrating a further means for aligning the sheets.
FIG. 8 is a fragmentary, transverse section taken along line 8—8 of FIG. 1B, illustrating means for holding down and restraining a stack of sheets being processed by the apparatus of the invention.

The sheet placed on the shuttle conveyer above described is further aligned, transmitted, and discharged from the conveyer by means of an indexing gate assembly indicated generally at 112 and illustrated in FIGS. 1A, 6 and 7.

The gate assembly is supported on a pair of grooved, vertical standards 114 positioned inwardly of and integral with frame members 16, 18. A pair of upper fluid operated cylinders, preferably air cylinders 116, and a pair of lower fluid operated cylinders, preferably air cylinders 118 are attached by bolts 120 to the upper and lower ends of the standards.

The cylinders rams 122 are attached by pins 124 to the outer ends 126 of upper gate member 128, and the outer ends 130 of lower gate member 132. Outer ends 126 and 130 of the gate members terminate within vertical grooves 134 formed on the inner faces 136 of standards 114.

The central portions 138 of the gate members operate between and within guides 80. Their lower edges are serrated, being provided with integral, downwardly extending short fingers 140 spaced to register with the raised portions 44 of bed plates 38 of the shuttle conveyer. Registering with grooves 47 on the latter, and interspersed with short fingers 140, are slightly longer fingers 142. These project into grooves 47 when gate members 128, 132 are lowered. In the fully lowered position of the gate members, short fingers 140 just clear the top surfaces of longitudinal ribs 44.

It will be recalled that when the sheets conveyed by the shuttle conveyer comprise plywood veneers, a handling problem is presented because the veneers tend to have a non-planar, wavy contour. Accordingly, sheet guide and restraining means are provided for guiding and restraining the leading ends of the sheets as they are introduced onto the shuttle conveyer. Such means is illustrated particularly in FIG. 7.

A horizontal, transverse finger plate 146 is mounted on the upper front edge of shuttle conveyers 34, 36 by means of screws 148 passing through spacer blocks 150 and entering tapped holes in bed plates 38. The spacing between the fingers of plate 146 is alternated with the spacing between fingers 140 of the serrated gate member to permit the downward extension of the vertical fingers of the latter.

A transverse guide 156 is positioned slightly ahead of and above each of finger plates 146. The outermost ends of guide 156 are mounted on grooved standards 114 by means of arms 158 and bolts 160 threaded into the standards.

Thus, in the operation of the gate assembly the leading end of an irregular sheet introduced onto the shuttle conveyer is guided by the angled surface of guide 156 beneath finger plate 146. Actuated by cylinders 116, the gate rises, permitting passage of the conveyor and a sheet superimposed thereon beneath the gate. At the conclusion of the advancing traverse of the conveyer, the gate lowers and the conveyer retracts. The long fingers 142 of the serrated gate member thereupon engage the trailing edge of the sheet, discharging it from the conveyer.

D. The Vertically Indexing Support Arm Assembly.

The sheet discharged by the conveyer in the manner described above is received by four cooperating, horizontally spaced pairs of vertically indexing support arms. In aggregate, the support arm subassemblies provide a plurality of upwardly indexing shelves, three in the illustration, for receiving the sheets, stacking them, and progressing them along the assembly line in an order and manner which composites them into a total sheet assembly having a desired continuity and lap pattern. The construction and manner of operation of this unit of the hereindescribed apparatus is illustrated in FIGS. 1A and 1B, 2 and 4.

All of the support arm subassemblies, indicated generally at 162, are tied together so that they may be indexed upwardly in unison by means of two pairs of upper and lower shafts 164, 166 journaled within bearings 168 fixed to frame members 16, 18. Sprockets 170 fixed to upper and lower shafts 164, 166 support endless chains 172.

As shown in FIG. 2 the outer links 174 of each chain 172 extend outwardly and are bent at opposing right angles to form ears 176. These are mounted to blocks 178, 180 entering threaded holes 182. Each block 178 supports on each side four rollers 184, operating in slots 186. The latter are located on the inner faces of vertical guideways 188 secured to the inner sides of frame 16, 18 by bolts 190. The guideways are of a length sufficient to engage three of blocks 178 at a time.

Located in the center of each block 178 is a hole 192 into which is threaded the inner end of an index arm 194. The latter is provided with three anti-friction rollers 196 spaced longitudinally along its outwardly extending portion 198.

To assist in the indexing of the support arms, there is provided in association with each indexing arm assembly a ratchet assembly 202, FIG. 2. This is mounted to the bottom of frame 16 along the center line of chain 172 by means of bolts 200.

The ratchet assembly consists of a case 204 with integral twin mounting lugs 206. Formed within case 204 is a horizontal bore 207 in which is slidably mounted a ratchet finger 208. The latter member has a relieved portion 209 at its operating end 210 so that it will clear the inner faces of the inner links 174 of chain 172. The operating end 210 of the finger terminates in an inclined surface 212.

A keyway 214 is formed in ratchet case 204. A key 215 is slidably positioned in the keyway and secured to ratchet finger 208 is the usual manner.

Ratchet finger 208 has an enlarged end 216 which operates in an enlarged bore 217. Positioned between enlarged end 216 and cover 218, secured by screws 219, is a compression spring 220 which forces the enlarged end 216 of the finger against a shoulder 222.

In the operation of the ratchet assembly, when the ascending chain link rollers 175 of chain 172 contact the inclined surfaces 212 of ratchet finger 208, the ratchet finger depresses, allowing rollers 175 to pass. However, upon cessation of the indexing drive, the finger effectively locks the chain in a stationary position.

Figure 4:
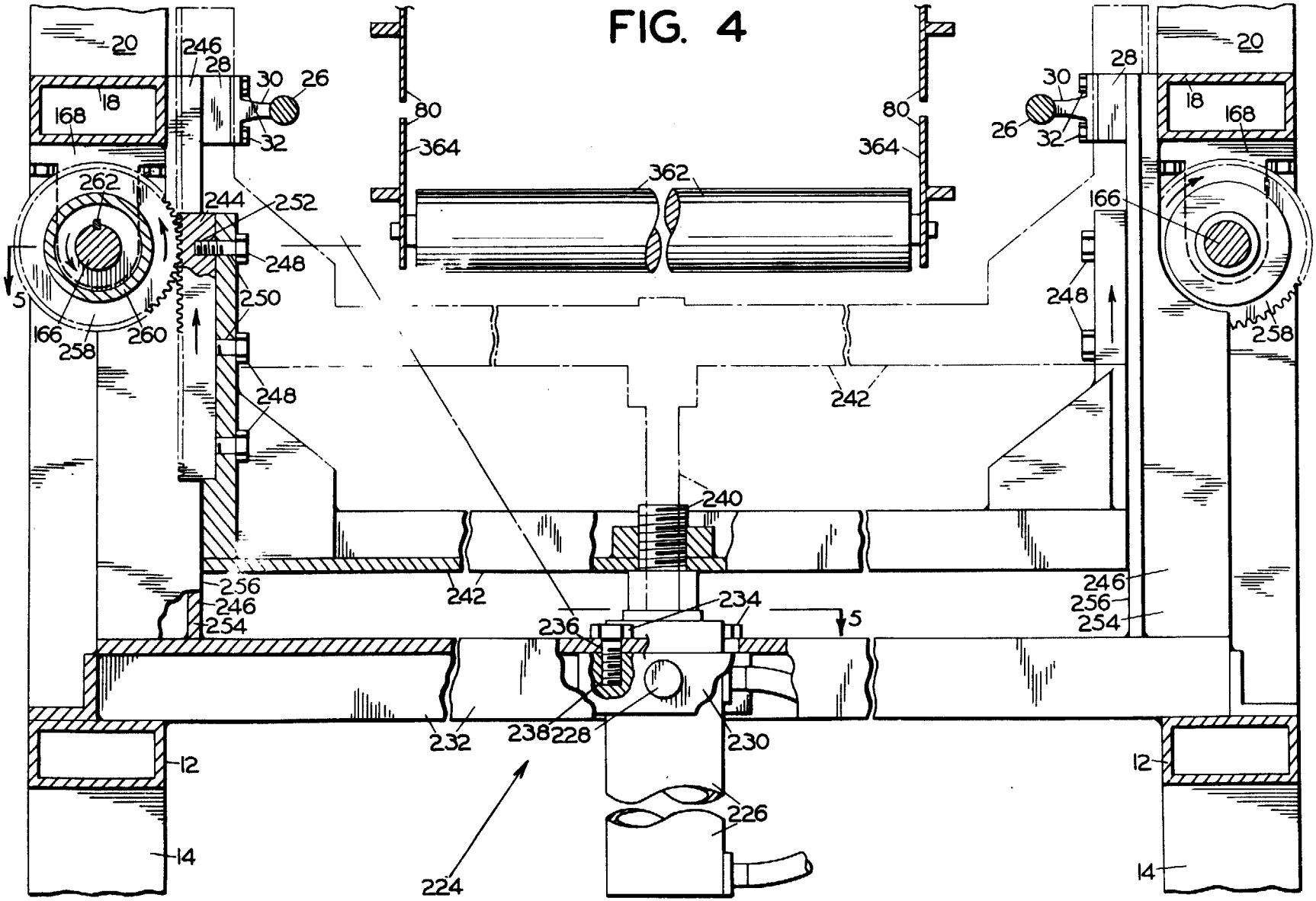
FIG. 4 is a transverse section taken along line 4—4 of FIG. 1B, illustrating the means for driving the support arms.

The drive for the indexing arm assemblies is shown in FIGS. 4 and 5.

Positioned between rearmost arm asemblies 162 is a transversely disposed indexing mechanism indicated generally at 224. A center line mounted actuating cylinder 226 is pivotally mounted by means of integral stud shafts 228 journaled within a mounting block 230 which is mounted to a transverse sub-frame member 232. Bolts 234 pass through holes 236 formed in sub-frame member 232 and enter tapped holes 238 formed within block 230.

The upper end of a cylinder ram 240 is secured to a transverse U-shaped frame 242. A pair of rack gears 244 are mounted to the vertical portion 246 of frame 242 by bolts 248. The latter pass through holes 250 in vertical members 246 and are threaded into tapped holes 252 formed in rack gears 244.

Rack gears 244 are slidably positioned between a pair of vertically spaced and angled frames 254 secured at their bottoms to sub-frame 232 and at their upper ends to frame 18. The inner faces 256 of angled frames 254 provide additional guides for the vertical portions 246 of frame 232.

Pinion gears 258 are rotatably journaled on shafts 166 and are aligned with rack gears 244. Slip clutches 260 are secured to the shafts by keys 262 and are joined with gears 258.

Thus, when it is desired to index the support arm assemblies upwardly, cylinder 226 is actuated. Both of shafts 166 thereupon are driven by the rack and pinion assemblies indexing all the support arm assemblies upwardly one stage through the agency of the interconnected chain and sprocket drives. The arms are maintained in their newly assumed positions by the action of ratchet assemblies 202. Cylinder 226 thereupon retracts, retracting racks 244. During their retraction, pinion gears 258 free wheel because of the action of the associated slip clutches 260. The drive then is ready for a subsequent indexing stroke.

E. The Sheet Hold-Down Assembly.

Figure 1B:
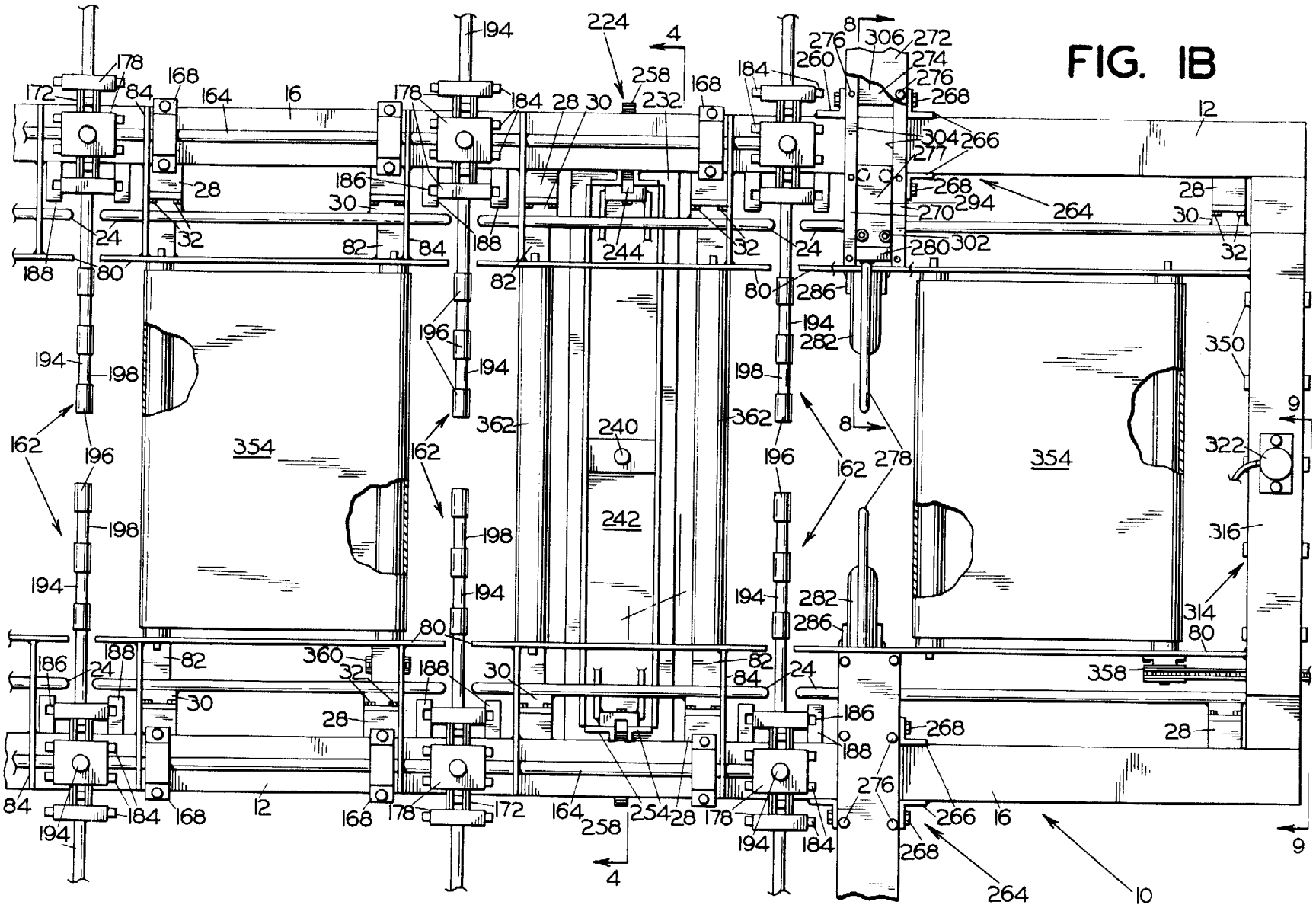

Means are provided for holding down and restraining the stacks of sheets built on the arms by the action of the shuttle conveyers, FIGS. 1B and 8.

The hold-down assemblies 264 are secured to frames 12 by integral angle frames 266 secured by bolts 268. Each hold-down assembly 264 consists of side walls 270 spaced and secured by upper and lower plates 272, 274 assembled by means of bolts 276.

An L-shaped carriage frame indicated generally at 277 mounts a pair of inwardly extending hold-down fingers 278 supported by and extending inwardly from a vertical segment 280 of the frame.

An actuating cylinder 282 is pivotably mounted by means of stud shafts 284 to a pair of ears 286 on side walls 270. The ram 288 of the cylinder is connected through pin 290 to a projection 292 on segment 294 of frame 277.

Two pairs of rollers 296 are attached to the sides of segments 280 and 294 of frame 277. They project into upper and lower tracks 298 and 300, respectively. An additional two pairs of rollers 302 are attached to the upper and lower surfaces of segments 294 and project slightly beyond the width of segment 294 contacting the inner surfaces 304 of walls 270. This provides lateral guide means for frame 277.

When ram 288 is extended, fingers 278 will be fully retracted within a chamber 306 formed by walls 270 and plates 272 and 274. When ram 288 is retracted, associated rollers 296 will enter inclined portions 308, 310 respectively, of tracks 298 and 300. This moves fingers 278 in an inward and downward direction until frame 277 contacts a stop 312 connected to walls 270. Then, as shown particularly in FIG. 8, the upper one of hold-down fingers 278 contacts and holds down a stack of sheets on an elevated sequence of arms while the lower one of hold-down fingers 278 contacts and restrains a stack of sheets on a lower group of arms.

Cooperating with finger assembly 264 is a hold-down roller assembly indicated generally at 314 and illustrated particularly in FIG. 9.

An inverted U-shaped frame 316 is secured to the inner face of frame 18 by bolts 318. It is further secured to a cross frame 232 by bolts 320.

An actuating cylinder 322 is mounted to frame 316 by bolts 324. The ram 326 of the cylinder is secured to the center of an inverted U-shaped movable frame 328 by pin 330.

Downwardly formed extensions 332 of frame 328 support two pairs of outwardly disposed rollers 334. These operate in vertical tracks 336 formed on the inner faces 338 of downwardly extended legs 340 of frame 316. Additional pairs of rollers 342 are positioned on the sides and lower portions of lower extensions 332 and project slightly beyond the faces 334 of extensions 332. They contact the inner faces 338 of extension members 340.

Rollers 334, 342, provide guiding means for the vertical movement of frame 328. A transverse shaft 346 is anchored at both ends to frame extensions 332 by pins 348. Rotatably mounted hold-down wheels 350 are evenly spaced and journaled on shaft 346 as shown in FIGS. 1b and 9. Positioned directly below wheels 350 is a support roller 352 having both of its ends journaled within a lower portion of frame 332.

F. The Lineal Conveying Assembly.

Sheets stacked on and fed from vertical support arm assemblies 162 are deposited in lapped sequence on a lineal conveying system illustrated in FIGS. 1 and 11. This conveys the resulting continuous assembly of lapped and stacked sheets to further processing, for example to a continuous plywood press.

The conveying system includes an interrupted series of conveyers 354. These are aligned with each other, co-planar, and alternated with the support arm assemblies, and positioned with their upper working stretches at an elevation slightly above the plane of the lowermost of the working arms of the support arm assemblies, as appears particularly in FIG. 11B.

All of the conveyers are coupled together and driven synchronously. Where the stacked sheets comprise plywood veneers being fed continuously to a continuous press 356, conveyers 354 advantageously may be locked into the continuous press drive thereby insuring that their movement is timed correctly with respect to the movement of the charge through the press. In this connection, it is to be noted that in one form of the invention the continuously stacked veneers may be drawn into the press by the action of the press drive, eliminating the necessity of applying power to conveyers 354.

However, in the illustrated embodiment, the conveyers all are driven by the drive of press 356 transmitted by means of drive chains 358, 360.

Transverse rollers 362 are randomly positioned along the same center line with conveyers 354 and provide additional support. Both conveyers and rollers find their ultimate support in frame members 364.

G. Operation.

In designing and programming the hereindescribed apparatus, account is taken of the size of the sheets and particularly of their thickness. In general the apparatus is designed to provide a minimum lap of the sheets of seven times, preferably ten times, the thickness of the sheets. Otherwise, a line of weakness develops along the lap joints present in the product. Also, particularly where the composited laminar product is many sheets thick, it is preferred to design the apparatus with two or more shuttle conveyers 34, 36 deposited two or more sheets simultaneously and correspondingly increasing the lineal distance between the lapped joints.

The stroke of the shuttle conveyers is correlated with the length of the sheets. To achieve a uniform result, the sheet length should be evenly divisible by the conveyer stroke length.

At the start of the operation, shuttle conveyers 34, 36 are retracted, aligning lever assemblies 86 are retracted, gate assemblies 112 are closed, and vertically indexing support arm assemblies 162 are stationary to provide three horizontal sequences of aligned arms. These form in effect three shelves upon which sheets may be stacked in lapped relation. Hold-down assemblies 264 are advanced and press 356 operates continuously. Lineal conveyers 354 drive synchronously in the advancing direction at the same rate as the press drive advances the work through the press.

At start-up the operator has two choices. Under one, he may manually lap and stack the start-up sheets, feeding them into the press and building up a charge on the conveyers and support arms which is a duplicate of that which would be build up thereon by operation of the shuttle and lineal conveyers. This eliminates end trim from the pressed billet.

In the alternative, he may start the apparatus of the invention and let it take its normal course. This ultimately will build up the press charge to the final thickness. However, this procedure necessitates trimming several feet off the leading end of the billet.

Figures 11A, 11B, 12, 13, 14, 15:
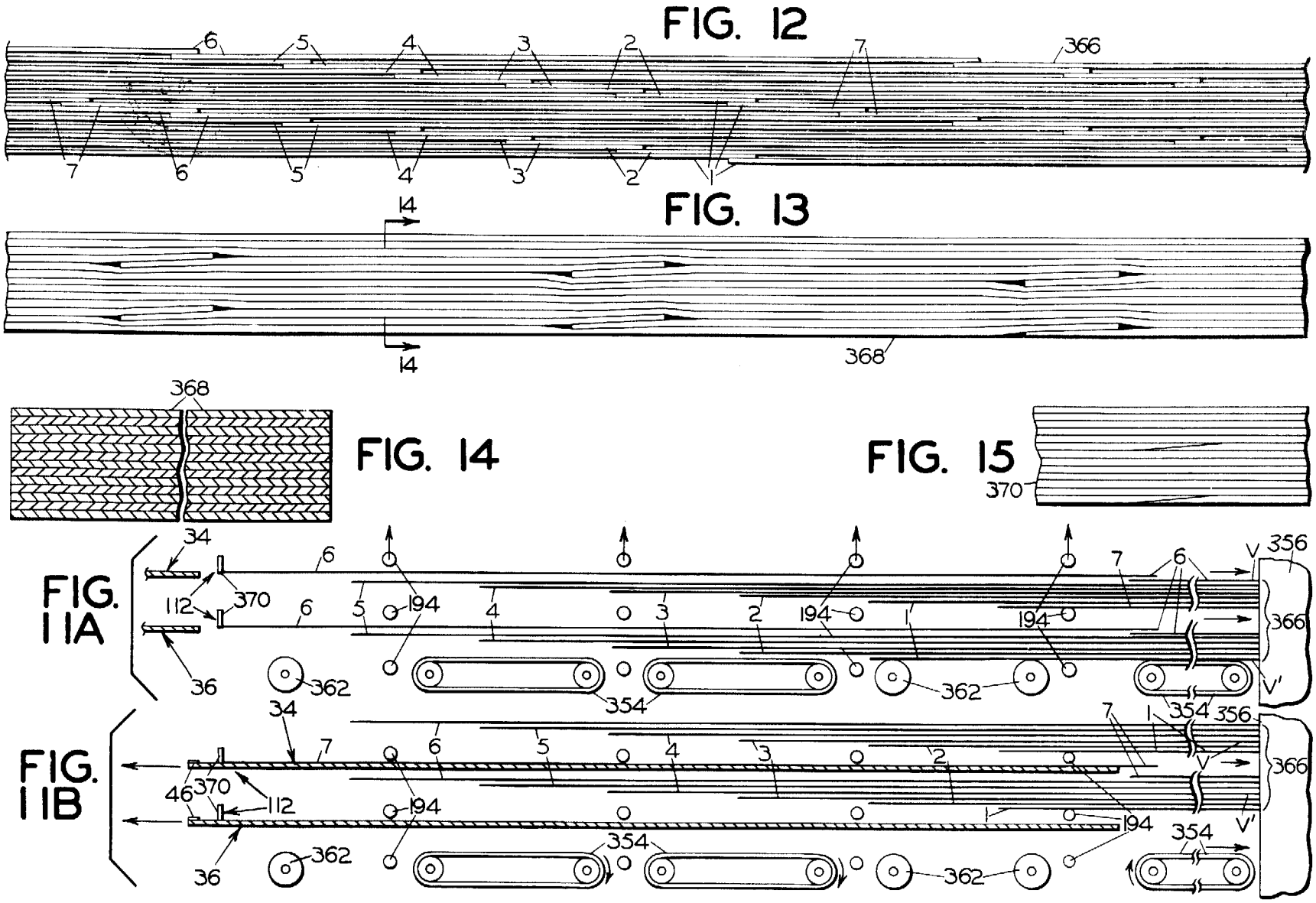
FIG. 11A is a diagrammatical side elevation illustrating the lay up pattern of a stack of sheets composited by the presently described apparatus, with the shuttle conveyors in retracted position and the indexing arms ready to be raised.
FIG. 11B is a progression of FIG. 11A, with the shuttle conveyors advanced.
FIG. 12 is a semi-diagrammatic, fragmentary elevation illustrating the lapped pattern of a stack of veneers after assembly, but before consolidation in a press.
FIG. 13 is a view similar to FIG. 12, but enlarged about four times thereover, and illustrating the stack after the application of consolidating pressure.
FIG. 14 is a foreshortened transverse section taken along line 14—14 of FIG. 13.
FIG. 15 is a fragmentary view corresponding to FIG. 13, but illustrating the application of sheets having scarfed ends in the method of the invention.
Figure 16:
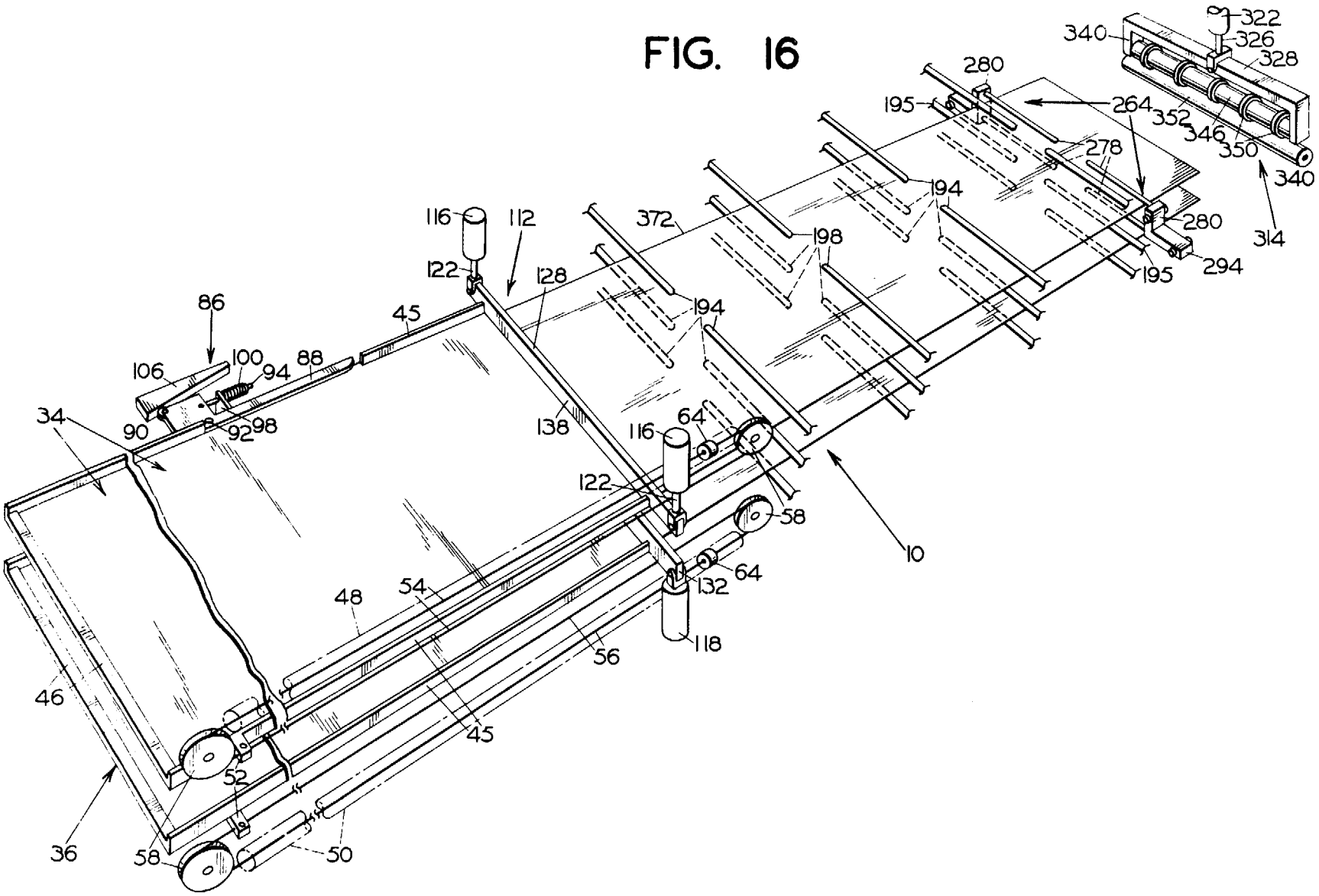
FIG. 16 is a schematic perspective view of the apparatus illustrating the arrangement of the principal subcombinations thereof.

The progressive build-up of the continuous stack is illustrated schematically in FIGS. 11A, 11B.

In interpreting FIGS. 11A and 11B it must be kept in mind that the showing of these figures is schematic. In particular, the sheets are represented for clarity of illustration in straight line parallel relationship. In actuality, because of their weight and flexibility, particularly in the case of plywood veneers, the sheets drape downwardly onto the supporting surfaces immediately below. These may be a succession of the support arms of assemblies 162, or one or more of lineal conveyers 354 or rollers 362. Also, in the illustration the sheets are assembled in two separate stacks by means of two separate shuttle conveyers. The sheets are thus shown in the drawings, but is is to be kept in mind that at the outfeed end of the apparatus the two stacks merge into a single stack which is then fed into press 356.

At the start of a cycle of operation the stack condition is essentially that illustrated in FIG. 11B, with a minor alteration which will be described later. A first stack of sheets V rests on the upper tier of support arms. A second stack of veneers V′ rests on the intermediate stack of support arms.

Shuttle conveyer 34 is arranged to pass between the upper and intermediate tiers of support arms, below the stack of sheets V. Shuttle conveyer 36 is arranged to pass between the intermediate and lower tiers of support arms, beneath the stack of sheets V'. Conveyers 354 underlie shuttle conveyer 36. The plane of the conveyers is slightly above the plane of the lower tier of support arms, so that the latter at this point are nonworking.

A sheet of material such as a plywood veneer now is introduced onto shuttle conveyer 34. Here it assumes the dashed line position of FIG. 1A. Gate assembly 112 is in its closed position.

In the next step of the operation the gate is raised and shuttle conveyer 34 advanced until the trailing end of the sheet is beyond the vertical plane of the gate. During its advancing motion, the sheet is aligned laterally by the action of lateral aligning assembly 86 including aligning lever 88. Inertial displacement of sheet rearwardly over the trailing end of the conveyer is prevented by pushing plates 46 thereon.

With upper conveyer 34 fully advanced, lower conveyer 36 is loaded and fully advanced in the same manner.

With both conveyers fully advanced, the associated gates are lowered and the conveyers retracted simultaneously. During retraction of the conveyers, the trailing ends of the sheets engage the leading faces of the gates, wiping the sheets off onto the respective underlying stacks of lapped sheets.

Linear conveyers 354 now are activated, as by locking them into the drive of press 356. This advances the stacks by a predetermined increment — sufficient to cause the underlying sheet of each stack to drop off the support bar which is farthest downstream and to come to rest on the underlying sheet with the sheet ends lapped by the precisely desired amount, as determined by the position of the gate assembly and sheet length.

Where an ultimate stack of thirteen sheets is required to achieve the desired billet thickness, the foregoing sequence is repeated six times. This deposits twelve sheets into subordinate stacks. The sheets of the upper stack are indicated at V in FIGS. 11A and 11B, while those of the lower stack are indicated by V'. The successively deposited sheets of each stack then are indicated by the successive numerals 1, 2, 3, 4, 5 and 6.

After twelve sheets have been deposited in this manner, vertical support arm assemblies are indexed upwardly one stage as indicated by the arrows of FIG. 11A. This puts the stacks in the condition indicated in FIG. 11B.

Where the total composite stack contains an even number of sheets, the foregoing sequence is repeated as described. However, if it is necessary to introduce an odd sheet, the thirteenth sheet in the present example, this is accomplished by introducing an odd sheet numbered 7 between the stacks of sheets V and V' in the manner indicated in FIG. 11B. The seventh sheet is introduced on the upper shuttle conveyer 34, the lower shuttle conveyer remaining empty.

The above described sequence then is repeated. The upper shuttle conveyer operates in the space between the stacks of sheets V and V' while the lower conveyer operates in the space between the lower stack of sheets V' and conveyers 354. They deposit the next series of sheets one at a time on the respective underlying surfaces. Then upon advancement of the conveyers one stage at a time, the lowermost sheets of the overlying stacks drop down on the freshly deposited sheets, lapping them by the desired increment.

When proceeding in this manner, similarly positioned sheets always will lap sheets of like kind deposited previously. Thus, a sheet V-1 will lap a previously deposited sheet V-1 and a sheet V-7 will lap a previously deposited sheet V-7 and so on.

Where the sheets comprise plywood veneers to be consolidated into a continuous laminar billet, they are first coated with a suitable plywood glue. Uppermost sheet V-6 is reserved from this treatment, however, and is applied dry save for a transverse strip of glue on its upper face, applied to provide a glue-coated lap surface.

As the two stacks of veneers V and V' leave the apparatus, the upper stack drops downwardly and merges with the lower stack into a unitary composite stack 366 of 13 sheets which is introduced into the press.

The structure of the product of the sequence above described is illustrated in FIGS. 12–15 inclusive.

FIG. 12 shows a typical pattern of thirteen sheets. In effect, this composite stack 366 is composed of an indefinite number of component stacks of thirteen sheets each, the sheets of each component stack being out of register by uniform increments in the linear direction, and the adjacent ends of adjacent stacks being interleaved and lapped by predetermined amounts. This produces a uniform pattern of lap joints which are spaced in the optimum manner for producing a consolidated product of maximum strength.

FIGS. 13 and 14 illustrate the stack after consolidation. It will be observed that the consolidated billet 368 is of indefinite length, and of a width determined by the width of the individual sheets. Where the individual sheets are of different widths, one side of the billet still will be of uniform thickness because of the aligning action of lateral aligning assembly 86. This has the advantage of requiring the longitudinal trimming of one side only of the billet to achieve a final billet of uniform thickness across its width.

Uniform thickness of the billet is achieved further by pressing the lapped sheets to uniform thickness in the press. As is indicated clearly in FIG. 13, in the case of wood veneers this requires some crushing and compression of the wood fibers in the lap joint areas. Any voids in such areas are filled with the glue with which the sheets are coated.

The formation of points of weakness such as cleavage planes is avoided by maintaining the spacing between the lap joints, both laterally and longitudinally, at optimum, uniform values. This insures uniform properties and uniform strength in the products. Where even greater strength is required, this may be achieved by scarfing the ends of the sheets and creating scarf joints rather than lap joints, in the manner indicated by the consolidated billet 370 of FIG. 15.

Having thus described our invention in preferred embodiments, we claim as new and desire to protect by Letters Patent:

1. The method of assembling of sheets of material into a linearly extending stack, comprising the steps of:

a. arranging a first stack of sheets above a rectilinear conveyer with the sheets progressively overlapped by predetermined increments in the direction of conveyer travel with the bottom sheet of the stack forwardmost and with the forward portion of said bottom sheet engaging the rectilinear conveyer, b. advancing the rectilinear conveyer by a predetermined increment to deposit said bottommost sheet of the first stack upon the rectilinear conveyer, c. placing a first sheet, which is to form one sheet of a second stack, on the rectilinear conveyer with its leading end overlapping the trailing end of the sheet from the first stack already deposited thereon, d. advancing the rectilinear conveyer by a predetermined increment to deposi the new bottommost sheet of the first stack on said first sheet of the second stack, e. placing a second sheet, which is to form part of the second stack, on said new bottommost deposited sheet of the first stack, f. repeating steps *b*, *c*, *d*, and *e* until all of the sheets of the first stack have been deposited on the rectilinear conveyer and a second stack has been built up thereon with its component sheets progressively overlapped at predetermined intervals with the sheets of the first stack, g. elevating the trailing end of the second stack above the conveyer, and h. building up on the rectilinear conveyer in like manner as specified in steps *b* to *g* successive overlapped stacks in a number calculated to produce a continuous sheet assembly of the desired length.

2. The method of claim 1 wherein the succession of bottommost sheets of a stack is deposited gravitationally simultaneously with the advancement of the rectilinear conveyer.

3. The method of claim 1 wherein the sheets comprise glue-coated wood veneers and including the steps of continuously pressing the continuous stack product under conditions predetermined to consolidate the stack, set the glue and produce a unitary laminated product.

* * * * *